United States Patent [19]

Deshpande

[11] Patent Number: 5,041,844

[45] Date of Patent: Aug. 20, 1991

[54] THERMAL INK JET PRINTHEAD WITH LOCATION CONTROL OF BUBBLE COLLAPSE

[75] Inventor: Narayan V. Deshpande, Penfield, N.Y.

[73] Assignee: Xerox Corporation, Stamford, Conn.

[21] Appl. No.: 548,353

[22] Filed: Jul. 2, 1990

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| Re. 32,572 | 1/1988 | Hawkins et al. | 156/626 |
| 4,532,530 | 7/1985 | Hawkins | 346/140 |
| 4,638,337 | 1/1987 | Torpey et al. | 346/140 |
| 4,723,136 | 2/1988 | Suzumura | 346/140 |
| 4,774,530 | 9/1988 | Hawkins | 346/140 |
| 4,835,553 | 5/1989 | Torpey et al. | 346/140 |
| 4,897,674 | 1/1990 | Hirasawa | 346/140 |

*Primary Examiner*—Joseph W. Hartary
*Attorney, Agent, or Firm*—Robert A. Chittum

[57] ABSTRACT

A thermal ink jet printhead is disclosed having an ink channel geometry that controls the location of the bubble collapse on the heating elements. The ink channels provide the flow path between the printhead ink reservoir and the printhead nozzles. In one embodiment, the heating elements are located in a pit a predetermined distance upstream from the nozzle. The channel portion upstream from the heating element has a length and a cross-sectional flow area that is adjusted relative to the channel portion downstream from the heating element, so that the upstream and downstream portions of channel have substantially equal ink flow impedances. This results in controlling the location of the bubble collapse on the heating element to a location substantially in the center of the heating elements.

8 Claims, 6 Drawing Sheets

THERMAL INK JET PRINTHEAD WITH LOCATION CONTROL OF BUBBLE COLLAPSE

BACKGROUND OF THE INVENTION

1. Field of the Invention

This invention relates to thermal ink jet printing devices and, more particularly, to thermal ink jet printheads having a channel geometry which controls the location of the bubble collapse on the heating elements, so that the cavitational forces do not directly impact the heating element/electrode interfaces.

2. Description of the Prior Art

Though thermal ink jet printing may be either a continuous stream type or a drop-on-demand type of ink jet printing, its most common use is that of drop-on-demand. As a drop-on-demand type device, it uses thermal energy to produce a vapor bubble in an ink-filled channel to expel a droplet. A thermal energy generator or heating element, usually a resistor, is located in the channels near the nozzle and, specifically, a predetermined distance upstream therefrom. The resistors are individually addressed with an electrical pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as droplet. The acceleration of the ink out of the nozzle while the bubble is growing provides the momentum and velocity of the droplet in a substantially straight line direction towards a recording medium, such as paper.

The environment of the heating element during the droplet ejection operation consists of high temperatures, frequency related thermal stress, a large electrical field, and a significant cavitational stress. The mechanical stress, produced by the collapsing vapor bubble, in the passivation layer over the heating elements are severe enough to result in stress fracture and, in conjunction with ionic inks, erosion/corrosion attack of the passivation material. The cumulative damage and materials removal of the passivation layer and heating elements result in hot spot formation and heater failure.

Upon further investigation, it has been found that the bulk of all heating element failures occur not on the resistor which vaporizes the ink, but rather at the junction or interface between the resistor and the addressing electrode connection the resistor to its driver.

The ink jet industry has recognized that the operating lifetime of the ink jet printhead is directly to the number of cycles or bubbles generated and collapsed that the heating element can endure before failure. Various printhead design approaches and heating element constructions are disclosed in the following patents to mitigate the vulnerability of the heating elements to cavitational stress, but none have controlled the location of the bubble collapse on the heating element to prevent it from collapsing near an electrode connection by channel geometry.

U.S. Pat. No. Re. 32,572 to Hawkins et al, discloses several fabricating processes for ink jet printheads, each printhead being composed of two parts aligned and bonded together. Many printheads can be simultaneously made by producing a plurality of sets of heating element arrays with their addressing electrodes on, for example, a silicon wafer and by placing alignment marks thereon at predetermined locations. A corresponding plurality of sets of channels and associated manifolds are produced in a second silicon wafer and, in one embodiment alignment, openings are etched thereon at predetermined locations. The two wafers are aligned via the alignment openings and alignment marks and then bonded together and diced into many separate printheads.

U.S. Pat. No. 4,638,337 to Torpey et al discloses an improved thermal ink jet printhead similar to that of Hawkins et al, but has each of its heating elements located in a recess. Recess walls containing the heating elements prevent the lateral movement of the bubbles through the nozzle and therefore the sudden release of vaporized ink to the atmosphere, known as blow-out, which causes ingestion of air and interrupts the printhead operation whenever this event occurs. In this patent, a thick film organic structure, such as Riston®, is interposed between the heater plate and the channel plate. The purpose of this layer is to have recesses formed therein directly above each heating element to contain the bubbles generated by the heating element, enabling an increase in droplet velocity without the occurrence of vapor blow-out.

U.S. Pat. No. 4,774,530 to Hawkins discloses an improved printhead which comprises an upper and lower substrate that are mated and bonded together with a thick insulative layer sandwiched therebetween. One surface of the upper substrate has etched therein one or more grooves and a recess, which when mated with the lower substrate, will serve as capillary filled ink channels and ink supplying manifold, respectively. Recesses are patterned in the thick layer to expose the heating elements to the ink, thus placing them in a pit and to provide a flow path for the ink from the manifold to the channels by enabling the ink to flow around the closed ends of the channels, thereby eliminating the fabrication steps required to open the groove closed ends to the manifold recess so that the printhead fabrication process is simplified.

U.S. Pat. No. 4,835,553 to Torpey et al discloses an ink jet printhead comprising upper and lower substrates that are mated and bonded together with a thick film insulative layer sandwiched therebetween. One surface of the upper substrate has etched therein one or more grooves and a recess which when mated with the lower substrate will serve as capillary filled ink channels and ink supply manifold, respectively. The grooves are open at one end and closed at the other. The open ends serve as nozzles. The manifold recess is adjacent the grooved closed ends. Each channel has a heating elements located upstream of the nozzle. The heating elements are selectively addressable by input signals representing digitized data signals to produce ink vapor bubbles. The growth and collapse of the bubbles expel ink droplets from the nozzles and propel them to a recording medium. A recess patterned in the thick layer provides a flow path for the ink from the manifold to the channels by enabling the ink to flow around the closed ends of the channels and increase the flow area to the heating elements. Thus, the heating elements lie at the distal end of the recesses so that a vertical wall of elongated recess prevents air ingestion while it increases the ink channel flow area and increases refill time, resulting in an increase in bubble generation rate.

U.S. Ser. No. 07/330,574 filed March 30, 1989 to Hawkins, entitled "Thermal Ink Jet Device with improved Heating Elements", now U.S. Pat. No. 4,935,752, discloses a thermal ink jet printhead which uses heating element structures which space the portion of the heating element structures subjected to the cavitational forces produced by the generation and collapsing of the droplet expelling bubbles from the upstream aluminum electrode interconnection to the heating element. In one embodiment this is accomplished by narrowing the resistive area where the momentary vapor bubbles are to be produced, so that a lower temperature section is located between the bubble generating region and the electrode connecting point. In another embodiment, the electrode is attached to the bubble generating resistive layer through a doped polysilicon descender. A third embodiment spaces the bubble generating portion of the heating element from the upstream electrode interface, which is most susceptible to cavitational damage, by using a resistive layer having two different resistivities.

U.S. Pat. No. 4,897,674, to Hirasawa, discloses a thermal ink jet printhead having a plurality of nozzles, an ink reservoir, and a plurality of parallel ink channels, with heating elements therein which provide ink flow paths from the reservoir to the nozzles. The cross-sectional area of the channels gradually decreases from the reservoir to the nozzles. Small walls are provided on the side of the channel adjacent the reservoir for the purpose of diminishing the loss of energy applied to the ink which escapes toward the reservoir.

The U.S. Pat. No. 4,638,337 improved the Reissue U.S. Pat. No. Re. 32,572 by providing an intermediate thick film layer between the heating element substrate and the channel wafer. The thick film layer is etched to expose the heating elements, thus placing them in a pit whose walls prevent lateral movement of the droplet emitting bubbles and prevent vapor blow-out and the ingestion of air that causes printhead failure. The U.S. Pat. No. 4,774,530 simplified the fabrication of the printheads by adding the etching of an ink flow path in the thick film layer between the reservoir and the channels. The ink channel cross-sectional flow areas prevented rapid refill with ink during the printing operation, slowing the printing speed. The U.S. Pat. No. 4,835,553 corrected this by creating a larger etched recess in the thick film layer by enlarging the thick film etched recess to connect and combine the heating element recess or pit and the ink flow passageway between the channels and the reservoir. Thus, the two basic types of thermal ink jet printheads are the separate or full pit structure of U.S. Pat. Nos. 4,638,337 and 4,774,530, schematically shown in FIGS. 2A and 2B, and the open pit structure of U.S. Pat. No. 4,835,553, schematically shown in FIGS. 3A and 3B. These prior art schematics are discussed in more detail later.

In U.S. Pat. No. 4,935,752, the problem of the collapsing bubble damaging the electrode interface with heating element was recognized as the reason most heating element failures occurred, and it solved this problem by designing the heating element so that the bubble generating region was always spaced from the upstream electrode interface.

The prior art printheads basically fall into three types of structures: the full pit structures, represented by FIGS. 2A and 2B; the open pit structures, represented by FIGS. 3A and 3B; and the no pit structures disclosed in U.S. Pat. Nos. Re. 32,572 and 4,935,752, to Hawkins. Experimental data shows that the bubble collapse of the no pit and a full pit configurations is near the upstream end of the heating element and the heating element failure takes place because of damage at the address electrode interface. High velocity fluid impact, referred to as cavitational stress or damage, appears to be the cause of this damage, and numerical modeling studies corroborate this behavior. Numerical modeling studies have shown that the bubble collapse for the open pit geometry takes place near the front, or downstream end, of the heating element, subjecting the common lead connection to cavitational damage, and experimental data have confirmed this.

SUMMARY OF THE INVENTION

It is the object of the present invention to provide a thermal ink jet printhead having a channel geometry which controls the location of the bubble collapse by balancing the relative magnitude of the fluid impedances of the channel portions on opposite sides of the heating elements.

It is another object of the invention to provide a thermal ink jet printhead having a channel geometry with a channel portion containing the heating element in a pit, an upstream or rear channel portion, and a downstream channel portion. The upstream channel portion having two sections, a relatively short section forming part of the heating element pit and the remainder of the channel between the reservoir and the heating element which has a larger cross-sectional flow area to achieve the balance of fluid impedances between the sections of the channel on opposite sides of the heating element.

In the present invention, a thermal ink jet printhead is disclosed for ejecting and propelling ink droplets to a recording medium on demand, during a printing mode, in response to electrical signals selectively applied to heating elements contained therein by electrodes connected thereto. The electrical signals energize the heating elements and cause the formation and collapse of momentary bubbles of vaporized ink on the heating elements. Each bubble causes the ejection of one droplet. The printhead comprises a structure having an ink reservoir in communication with an array of nozzles through a parallel array of elongated channels. Each channel has a heating element therein located a predetermined distance upstream from its associated nozzle. Substantially equal ink fluid flow impedances are provided between the channel portions upstream and downstream of the heating elements for the ink motion during the printing mode to control the location of the bubble collapse on the heating element. By controlling the location of the bubble collapse, it is kept away from the interface connection of the electrodes to the heating elements, thus, preventing cavitational damage resulting from the bubble collapse to the vulnerable electrode interface connection.

A more complete understanding of the present invention can be obtained by considering the following detailed description in conjunction with the accompanying drawings wherein like parts have the same index numerals.

DESCRIPTION OF THE PREFERRED EMBODIMENT

Figure 1:
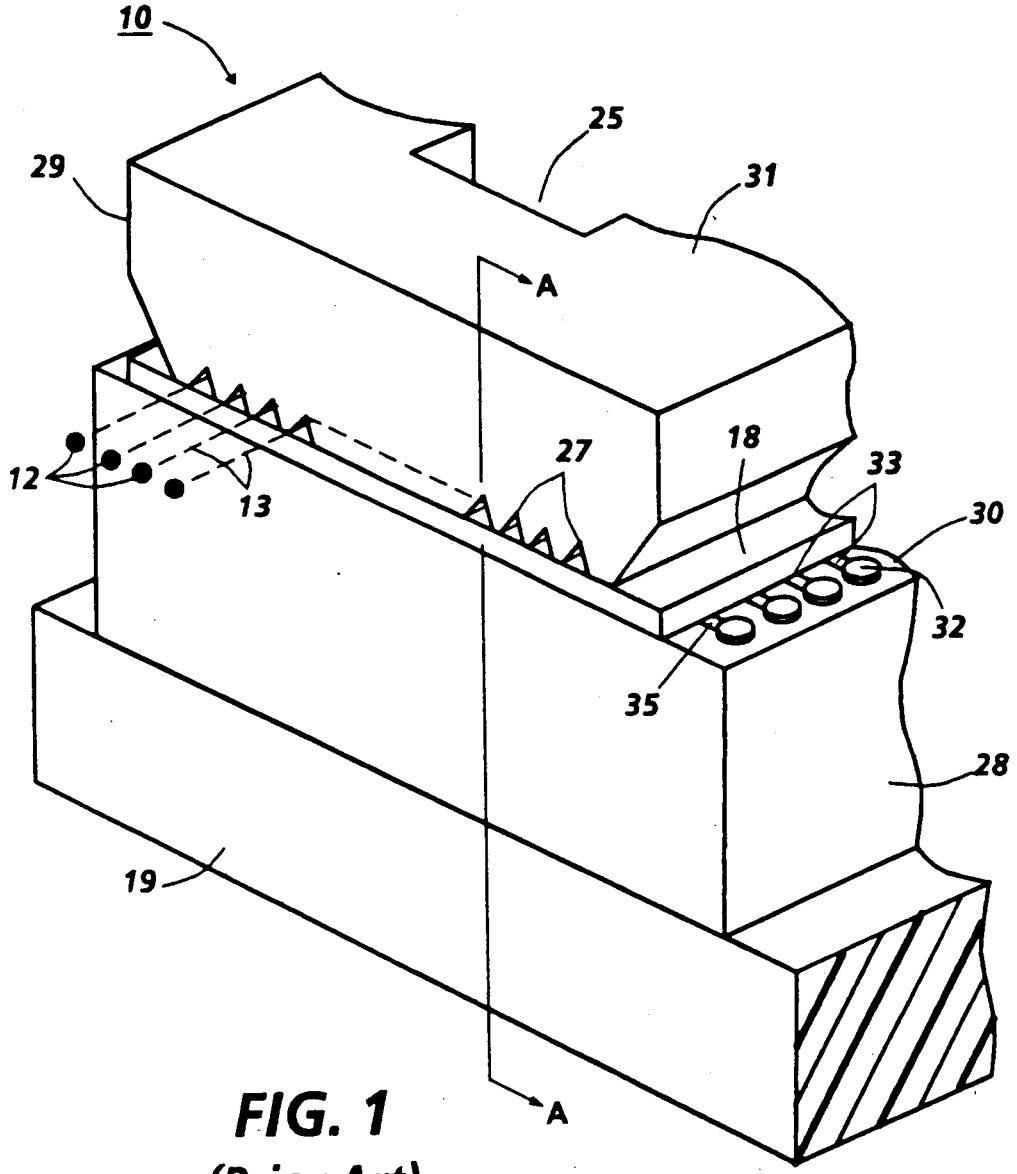
FIG. 1 (Prior Art)
FIG. 1 is a schematic, partial isometric view of a typical thermal ink jet printhead.

An enlarged schematic isometric view of a typical prior art head 10, showing the array of droplet emitting nozzles 27 in front face 29 of channel plate 31, is depicted in FIG. 1. Ink droplets 12 follow trajectories 13 shown in dashed line from the nozzles to a recording medium, not shown. Referring also to FIGS. 2 and 3, which are cross-sectional views along view line A—A showing two prior art embodiments, the lower electrically insulating substrate or heating element plate 28 has the heating elements 34 and addressing electrodes 33 patterned on surface 30 thereof, while the upper substrate or channel plate 31 has parallel grooves 20 which extends in one direction and penetrate through the channel plate front face 29. The other end of grooves terminate at slanted wall 21. Internal recess 24 is used as the ink supply manifold or reservoir for the capillary filled ink channels 20. The reservoir has an open bottom 25 for use as an ink fill hole. The surface of the channel plate with the grooves are aligned and bonded to the heating element plate 28 so that a respective one of the plurality of heating elements 34 is positioned in each channel formed by the grooves and the lower substrate or heating element plate. Ink enters the manifold or reservoir formed by the recess 24 and the heating element plate 28 through the fill hole 25 and, by capillary action, fills the channels 20 by flowing through, a common recess 38 formed in the thick film insulative layer 18, as shown in FIGS. 2 and 3. The ink at each nozzle forms a meniscus at a slight negative pressure, which prevents the ink from weeping therefrom. The printhead 10 is mounted on a ceramic coated, metal substrate 19 containing electrodes which are used to connect the heating elements to control circuitry (not shown).

The addressing electrodes 33 on the channel plate 28 terminate at terminals 32. The channel plate 31 is smaller than that of the lower substrate 28 in order that the electrode terminals 32 are exposed and available for connection to the control circuitry (not shown) via the electrodes (not shown) on the substrate 19. Layer 18 is a thick film passivation layer, sandwiched between upper and lower substrates. Referring to FIG. 2, this layer is patterned to form a common recess 38 together with a plurality of recesses 37 which form pits that expose each of the heating elements. Refer to U.S. Pat. No. 4,774,530. In FIG. 3, the thick film layer is patterned to form a common recess 38 and a plurality of elongated parallel recesses or troughs 26 extending from and in communication at one end with the common recess. The distal ends of the etched troughs have the heating elements, thus placing them at the bottom of the trough distal end. Refer to U.S. Pat. No. 4,835,553. The common recess 38 enables ink flow between the manifold 24 and the channels 20. In addition, the thick film insulative layer is etched to expose the electrode terminals.

Figure 2A:
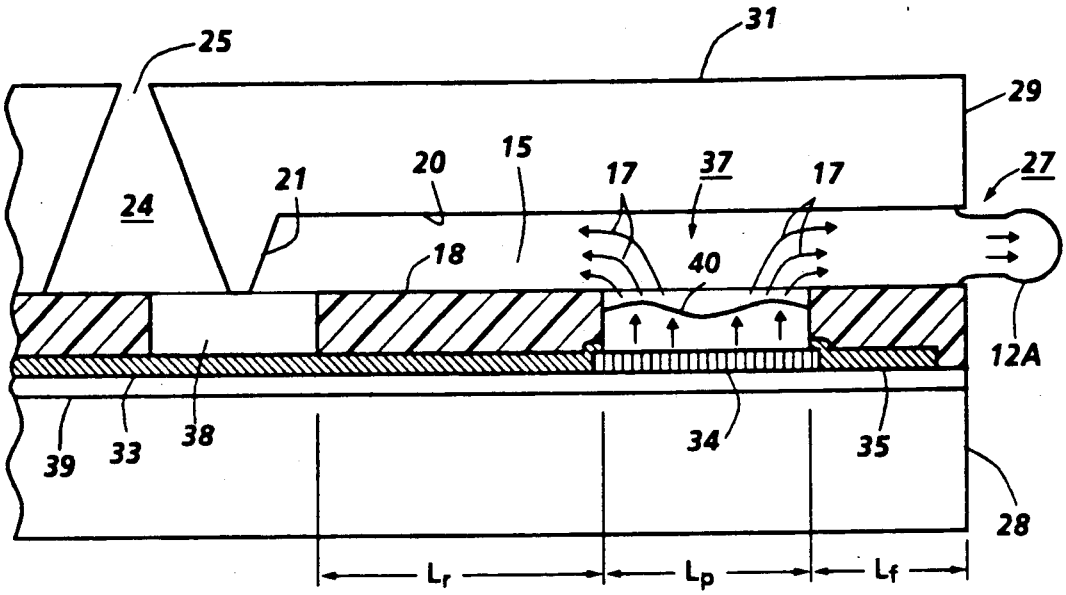
FIG. 2A (Prior Art)
FIGS. 2A and 2B are partial views of the printhead as viewed along view line A—A of FIG. 1, showing a cross-sectional view of an ink channel having a prior art geometry.
Figure 2B:
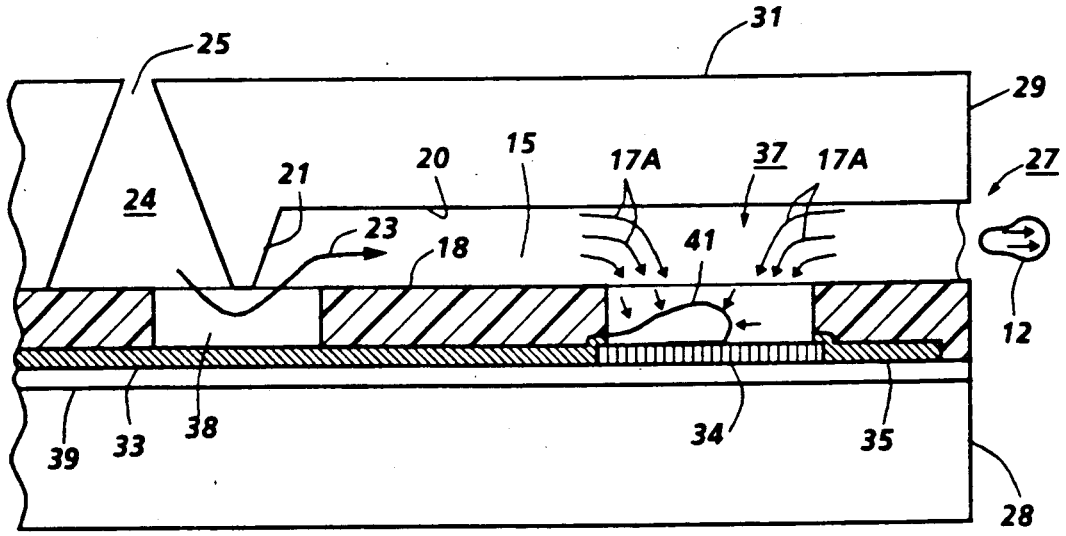
FIG. 2B (Prior Art)
Figure 3A:
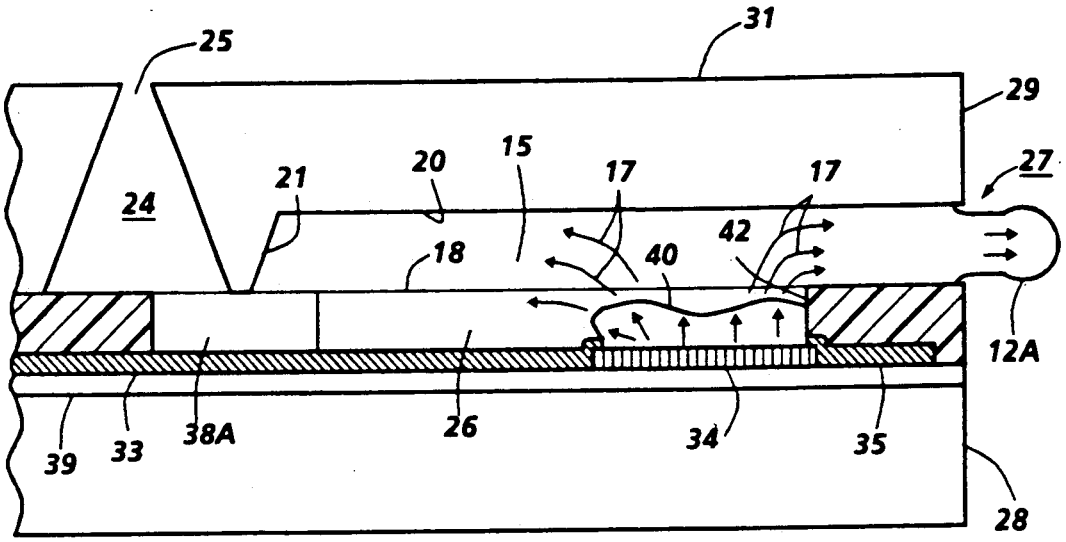
FIG. 3A (Prior Art)
FIGS. 3A and 3B are partial views of the printhead as viewed along view line A—A of FIG. 1, but showing a cross-sectional view of another prior art ink channel geometry.
Figure 3B:
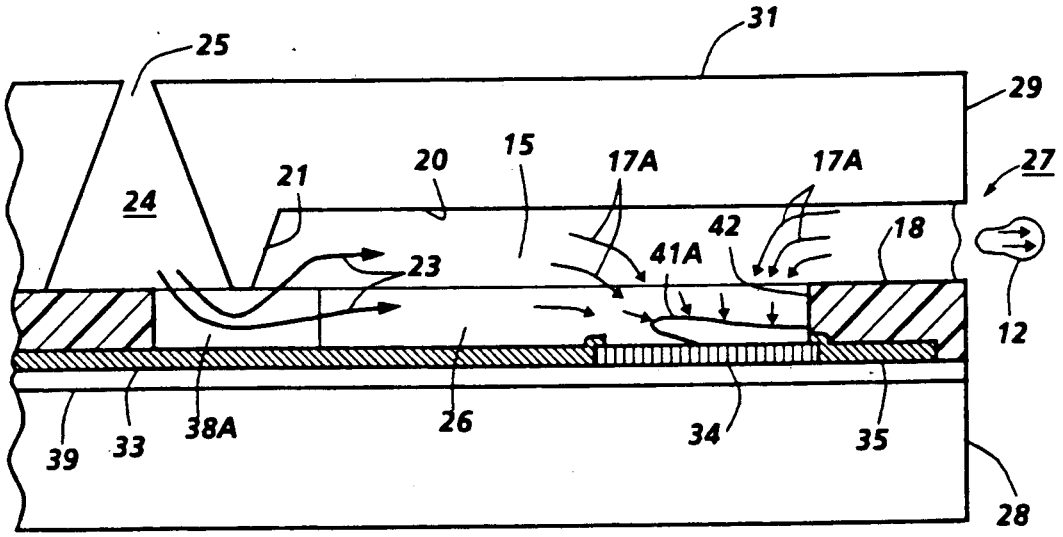
FIG. 3B (Prior Art)

A schematic cross-sectional view of FIG. 1 is taken along view line A—A through one channel and shown as alternate prior art embodiments in FIGS. 2 and 3 to show how the ink flows from the manifold 24 and around the closed end 21 of groove 20 as depicted by arrow 23. Also shown, but discussed later, is the growth of droplet ejecting bubbles 40 in FIGS. 2A and 3A and the cavitational damage producing collapse of the bubbles 41 and 41A in FIGS. 2B and 3B, respectively. A plurality of sets of bubble generating heating elements 34 and their addressing electrodes 33 are patterned on the polished surface of a single side polished (100) silicon wafer (not shown). Prior to patterning, the multiple sets of printhead electrodes 33, the resistive material that serves as the heating elements, and the common return 35, the polished surface of the wafer is coated with an underglaze layer 39, such as, silicon dioxide, having a thickness of about 1–2 micrometers. The resistive material may be doped polycrystalline silicon which may be deposited by chemical vapor deposition (CVD) or any other well known resistive material such as zirconium boride ($ZrB_2$). The common return 35 and the addressing electrodes 33 are typically aluminum leads deposited on the underglaze and over the edges of the heating elements. The common return and addressing electrode terminals 32 are positioned at predetermined locations to allow clearance for electrical connection to the control circuitry, after the channel plate 31 is attached to the heating element plate to make a printhead. The common return 35 and the addressing electrodes 33 are deposited to a thickness of 0.5 to 3 micrometers, with the preferred thickness being 1.5 micrometers. For further details, refer to the patents discussed in the prior art section.

In the preferred embodiment of the present invention, and as discussed in the prior art, polysilicon heating elements are used and a silicon dioxide thermal oxide layer (not shown) is grown from the polysilicon in high temperature steam. For more details about the production of polysilicon heating elements, refer to U.S. Pat. Nos. 4,532,530 and 4,935,752 to Hawkins. The thermal oxide layer is typically grown to a thickness of 0.5 to 0.1 micrometer to protect and insulate the heating elements from the conductive ink. The thermal oxide is removed at the edges of the polysilicon heating elements for attachment of the addressing electrodes and common return, which are then patterned and deposited. Before electrode passivation, a tantalum (Ta) layer (not shown) may be optionally deposited to a thickness of about 1 micrometer on the heating element protective layer for added protection thereof against the cavitational forces generated by the collapsing ink vapor bubbles during printhead operation. For electrode passivation, a two micrometer thick phosphorus doped CVD silicon dioxide film (not shown) is deposited over the entire wafer surface, including the plurality of sets of heating elements and addressing electrodes. The passivation film provides an ion barrier which will protect the exposed electrodes from the ink. An effective ion barrier layer is achieved when its thickness is between 1000 angstrom and 10 micrometers, with the preferred thickness being 1 micrometer. The passivation layer is etched off of the heating element or Ta layers and terminal ends of the common return and addressing electrodes for electrical connection to the control circuitry. The etching of the silicon dioxide film may be by either the wet or dry etching method.

Figure 5:
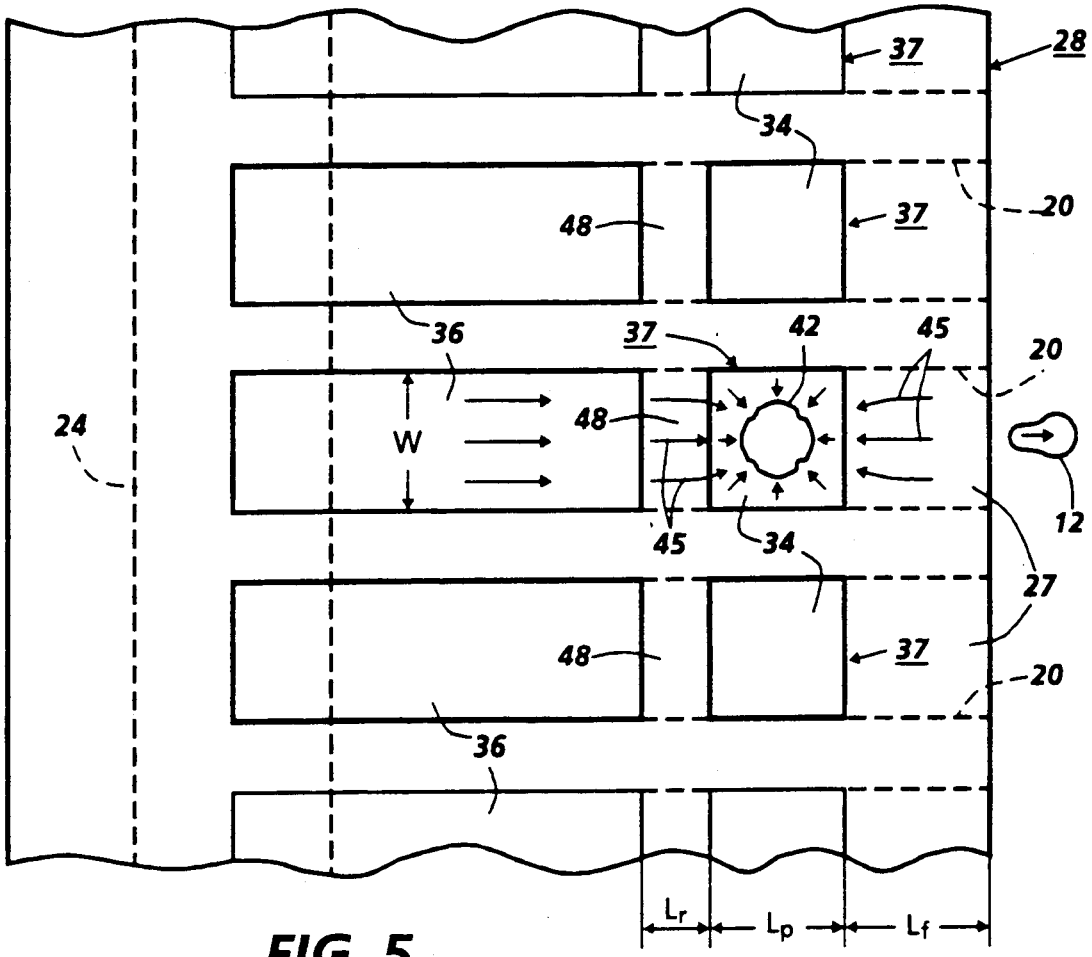
FIG. 5 is a partial view of the printhead as viewed along view line B—B of FIG. 4B, showing a plan view of the ink channels of the present invention.
Figure 6:
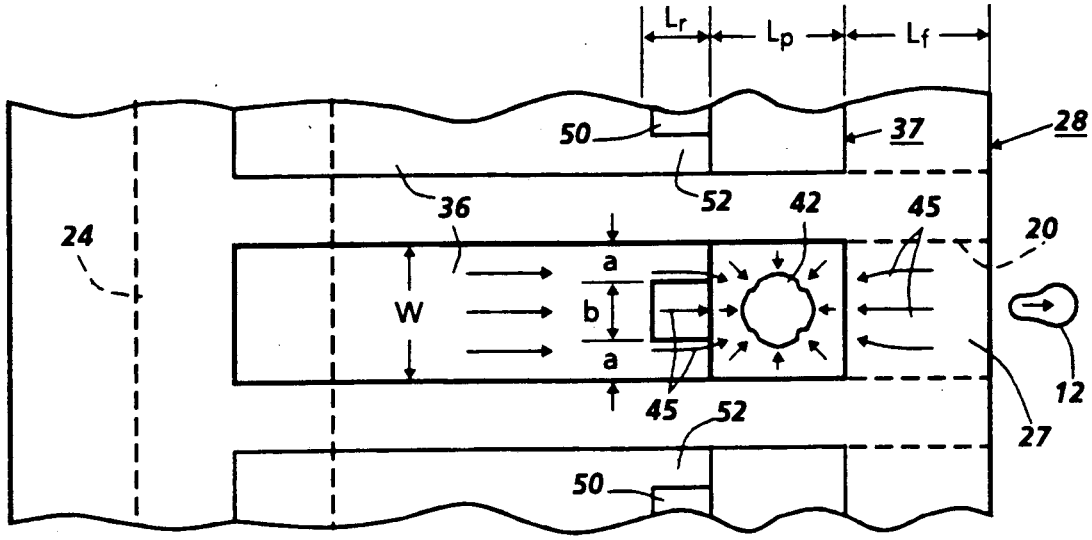
FIG. 6 is a plan view similar to FIG. 5, showing an alternate embodiment of the invention.
Figure 7:
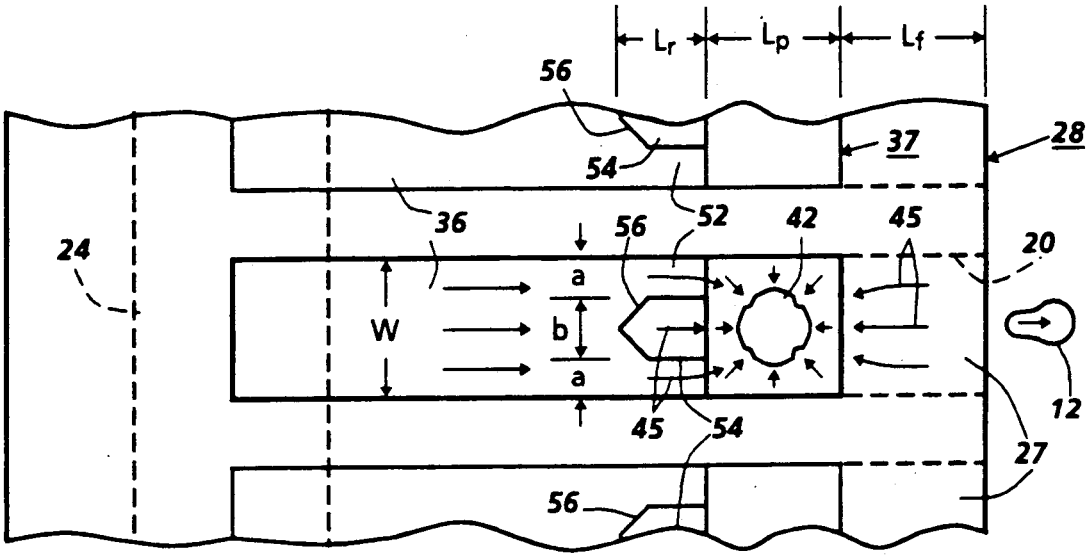
FIG. 7 is a plan view similar to FIG. 5, showing another embodiment of the invention.

Next, a thick film type insulative layer 18 such as, for example, Riston ®, Probimer 52 ®, or polyimide, is formed on the passivation layer of the present invention having a thickness of between 5 and 100 micrometers and preferably in the range of 10 and 50 micrometers. The insulative layer 18 is photolithographically processed to enable etching and removal of those portions of the layer 18 which cover each heating element and, of those elongated portions of layer 18 which are aligned with the ink channels between a location within the reservoir to the wall 48 of thick film material adjacent the heating element to form pits 37 and troughs 36, as shown in FIG. 5. FIGS. 6 and 7 show alternate embodiments wherein wall 48 is replaced by islands 50 and 54, respectively. In an embodiment not shown, the ends of the troughs within the reservoir are connected to a common recess similar to that disclosed in U.S. Pat. No. 4,835,553 and shown in FIG. 3 as common recess 38A. The prior art printhead of FIG. 2 has a patterned thick film layer which has common recess 38 providing ink passage from the ink manifold 24 to each of the ink channels 20, and a plurality of recesses or pits 37 to expose each heating element. In FIG. 3, instead of pits 37, elongated recesses 26 extending from the heating elements and into communication with the common recess 38A are used. In addition, the thick film layer 18 is removed over each electrode terminal 32. Referring to FIG. 3, the plurality of the combined elongated recesses 26 and common recess 38A for each set of heating elements on the wafer, which is to be subsequently divided into individual heating elements plates 28, is formed by the removal of these portions of the thick film layer 18. Thus, the passivation layer alone protects the electrodes 33 from exposure to the ink in this recess composed of a common recess 38A with a plurality of parallel elongated recesses 26 extending therefrom. The common recess 38A is located at a predetermined position to permit ink flow from the manifold to the channels, after the channel plate 31 is mated thereto. The distal end of the elongated recesses 26 exposed each heating element and the rest of the elongated recesses enlarge the ink flow areas in each ink channel. The common recess 38A, which is in communication with the plurality of elongated recesses 26, opens the ink channels to the manifold 24. The distal end wall 42 of the elongated recess 26 inhibits lateral movement of each bubble generated by the pulsed heating element and thus promotes bubble growth in a direction normal thereto, while the rest of the elongated recess increases the ink flow area and enables faster refill time during the printhead operation. The blow-out phenomena of releasing a burst of vaporized ink with the consequent ingestion of air is avoided.

Figure 4A:
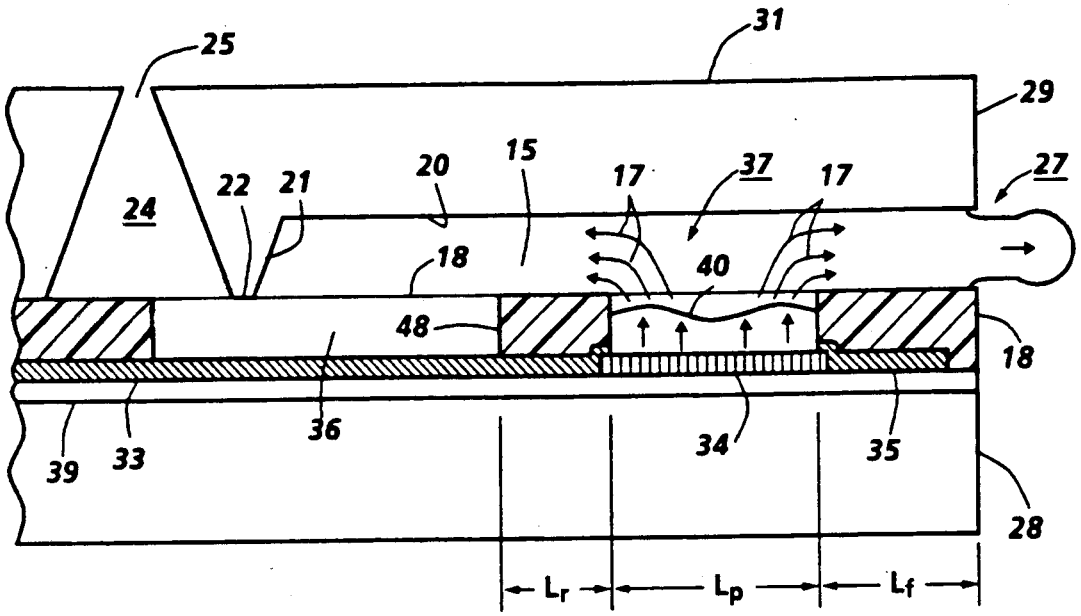
FIGS. 4A and 4B are partial views of the printhead as viewed along view line A—A of FIG. 1, showing a cross-sectional view of an ink channel having the geometry of the present invention.

As disclosed in U.S. Pat. No. Re. 32,572 and U.S. Pat. Nos. 4,638,337, 4,835,553 and 4,935,752, all incorporated herein by reference, the channel plate 31 of the present invention, shown in FIG. 4, is formed from a two-side-polished, (100) silicon wafer (not shown) to produce a plurality of upper substrates or channel plates 31 for the printhead 10. After the wafer is chemically cleaned, a pyrolytic CVD silicon nitrite layer (not shown) is deposited on both sides. Using conventional photolithography, relatively large rectangular recesses 24 and sets of elongated, parallel channel recesses 20 are patterned and anisotropically etched. These recesses will eventually become the ink manifolds with open bottom 25, and channels of the printheads. The surface 22 of the wafer containing the manifold and channel recesses are portions of the original wafer surface on which adhesive will be applied later for bonding it to the patterned thick film layer 18 covering the heating element plate 28. A final dicing cut, which produces end face 29, opens one end of the elongated groove 20 producing nozzles 27. The other ends of the channel groove 20 remain closed by end 21. However, the alignment and bonding of the channel plate to the heater plate places the ends 21 of channels 20 directly over the troughs 36 in the thick film insulative layer 18 as shown in FIG. 4, enabling the flow of ink into the channels from the manifold. Optionally, but not shown, the trough ends opposite the ones nearer the heating elements could terminate in a common recess similar to the prior art shown in FIG. 3, as mentioned above.

U.S. Pat. No. 4,774,530 and prior art FIGS. 2A and 2B shows an ink jet printhead having a relatively long channel through which ink is supplied from the reservoir to the nozzle. The heater which produces the bubble is placed in a pit in a thick film layer in the channel upstream from the nozzle opening. The pit prevents air ingestion, thus avoiding printhead failure. Analysis of such a printhead configuration indicates that it can be operated at a maximum frequency of about 5 KHz at 300 spots per inch (SPI) printing. The operating frequency is governed by the channel refill time. It is known by those skilled in the art that the channel offers the maximum resistance to flow in the printhead. U.S. Pat. No. 4,835,553 and prior art FIGS. 3A and 3B delineate a geometry which minimizes the channel resistance, making it possible to operate the printhead at a frequency increased by at least 20–30%. The pit geometry of FIGS. 2A and 2B are eliminated and instead only a step is provided which prevents air ingestion. The passageway from the heater to the reservoir is enlarged by the elongated recess 26 to increase the cross-sectional flow area and minimize the flow resistance.

FIGS. 2A and 2B show a schematic cross-section of a prior art channel with the full pit geometry. This geometry is disclosed in U.S. Pat. Nos. 4,638,337 and 4,774,530. It consists of the front channel length ($L_f$) downstream of the heating element 34, a rear channel length ($L_r$) upstream of the heating elements, and a pit length ($L_p$) covering that portion of the channel containing the heating element. During the time of bubble growth, the ink 15 is pushed away from the pit 37, so that the ink flows out through the front channel portion, causing the ink to bulge from the nozzle 27 as protrusion 12A, and concurrently flows towards the reservoir at the end of the rear channel portion, as indicated by arrows 17. During the bubble collapse, shown in FIG. 2B, the ink 15 moves into the pit 37 from both front and rear channel portions, as shown by arrows 17A, and from the reservoir as shown by arrow 23. However, because $L_r$ is larger than $L_f$ and they have the same flow area, the ink flowing from the rear channel portion has higher flow resistance than that in the front channel portion. As a result, more ink moves into the pit 37 from the front channel portion and this behavior pushes the collapsing bubble 41 to the rear of it. Eventually, the bubble collapses at or near the electrode 33 interfacing connection with the heating element 34 at the rear of the pits, which interface is known to the susceptible of cavitational damage, and the cavitational force generated by the collapsing bubble, together with the ink from the front channel portion, impacts the rear or upstream end of the heating elements in the pit and subjects the upstream electrode interface or connection to the large cavitational forces. As the bubble collapses, droplet 12 is ejected.

The behavior of bubble collapse in a prior art channel with an open pit geometry is shown in FIGS. 3A and 3B, a schematic cross-sectional view of a channel configuration disclosed in U.S. Pat. No. 4,835,553 to Torpey et al. The rear channel or upstream portion in this geometry has a larger cross-sectional flow area than the front channel portion. The ink 15 is pushed away through both front and rear channel portions as in the full pit geometry of FIG. 2A and shown by arrows 17. However, the ink motion in the channel geometry of FIG. 3 is different during the bubble collapse. In this configuration, the ink in the rear channel portion, that is upstream of the heating elements, has lower fluid flow resistance than the ink in the front channel portion that is downstream of the heating element. The ink 15 flowing from the rear channel portion towards the bubble 41A has lower flow resistance or impedance, as well as no sharp corners to turn around. As a result, the collapsing bubble 41A in FIG. 3B gets pushed forward towards the front of the heating element 34 by this ink flow. The bubble collapse and ink impact the common electrode 35 interfacing connection with the heating element 34, so the cavitational forces are directed to this interface and induce damage to the common electrode interface. It was recognized in U.S. Pat. No. 4,935,752 that the electrode interfaces with the heating elements are structurally weaker. A number of different material layers make up this electrode interface, requiring step coverage to further make it susceptible to damage and delamination.

Instead of providing specially configured heating elements which always space the growing and collapsing bubble away from the electrode interface with the heating elements, as disclosed in U.S. Pat. No. 4,935,752, this invention uses a modified upstream or rear channel geometry to control the bubble collapse and keep it substantially centered on the heating element. The full pit and open pit geometries, shown in FIGS. 2 and 3, represent the upper and lower limit to the flow resistance in their respective channels. Intermediate values are obtained by shortening the rear channel or the cross-sectional flow area that is substantially equal to the front or downstream cross-sectional flow area of the channel 20. Thus, the larger portion of the upstream channel portion between the portion identified as $L_r$ and the reservoir 24 provide much lower fluid impedance, so that the length $L_r$ of the channel having the reduced cross-sectional flow area immediately upstream of the heating element may be shortened to a length or thickness to withstand the forces generated by the growth and collapse of the bubbles and to a length sufficiently long to balance the total rear channel portion fluid flow impedance with that of the front channel portion fluid flow impedance with that of the front channel portion fluid flow impedance. By adjusting the length $L_r$, the bubble collapse occurs at the desired location substantially in the center of the heating element. Accordingly, the present invention is shown in schematic cross-sectional views of FIGS. 4A and 4B which are similar to that of the prior art ink channel cross-sectional views shown in FIGS. 2 and 3 for ease of comparison.

The downstream or front channel portions $L_f$ are all about 100 to 140 μm and preferably about 120 μm. The heating element length $L_p$ between the front and rear electrode connections or interfaces are all about 80 μm to 140 μm, and preferably between 115 to 130 μm. The distance from the channel plate surface 22 at the interface with slanted wall 21 of the channel groove 20 (adjacent the reservoir 24) to the upstream edge of the heating element is about 100 to 200 μm and preferably 140 μm. In the present invention the distance $L_r$ is 10 to 50 μm and preferably 20 to 30 μm.

Figure 4B:
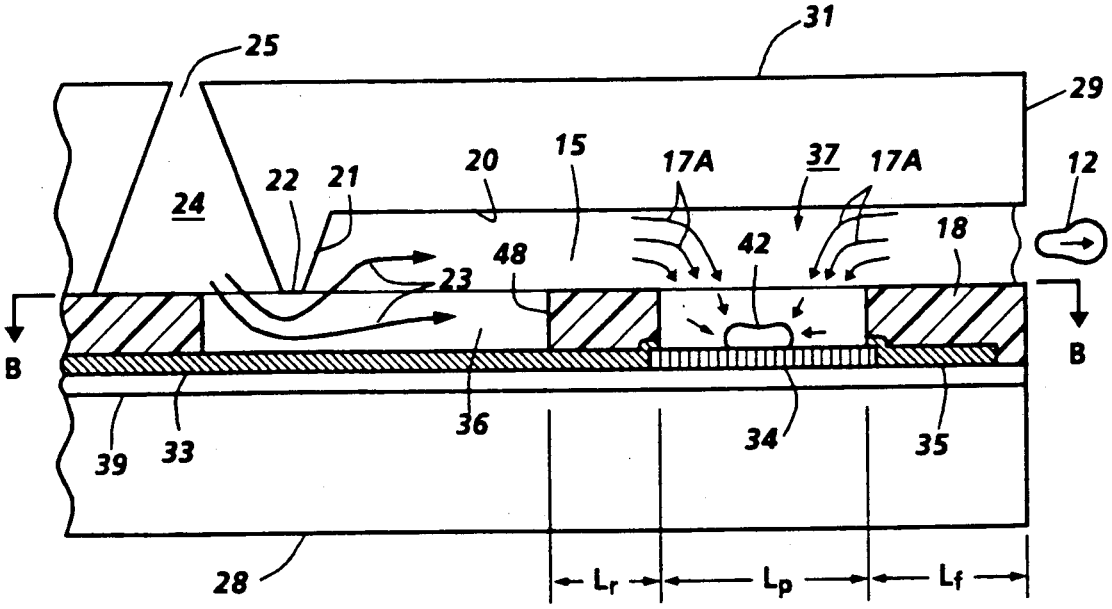

FIG. 5 is a plan view of a portion of the heating element plate 28 of the present invention converted by patterned thick film layer 18 as viewed along view line B—B of FIG. 4B. In FIG. 5, the reservoir 24 and ink channels 20 are shown in dashed line. The width (W) of the troughs 36 and pits 37 patterned in the thick film layer 18 are clearly shown to be substantially the same width as the channels 20. Arrows 45 show the flow of ink 15 towards the collapsing bubble 42, which is centered on the heating element 34 in pit 37, well away from either upstream or downstream electrode interface with the heating elements.

In an alternate embodiment of the present invention (not shown) the ends of the troughs 36 extending into the reservoir 24 may be commonly connected to a relatively large recess similar to the geometry of the channels of U.S. Pat. No. 4,835,553. In another embodiment of the invention, not shown, the troughs 36 terminate near the intersection of the slanted wall 21 and the channel plate surface 22 and do not extend into the reservoir 24. To enable communication between the reservoir and the channels with the troughs the slanted wall must be removed by dicing or etching as taught by U.S. Pat. No. Re. 32,572.

The invention of FIGS. 4 and 5 have a slight frequency response reduction over that of the prior art open pit geometry shown in FIG. 3, but much better than that of the full pit geometry shown in FIG. 2. An alternate embodiment of the invention disclosed in FIGS. 4 and 5 is shown in FIG. 6, a plan view similar to that of FIG. 5. Instead of a solid piece 48 of thick film layer forming pit 37 in FIG. 5, and island 50 of thick film layer material is used for the upstream pit wall with gaps 52, which enable ink to flow around as well as over the island to refill the pit 37 with ink as the bubble 42 collapses. The gaps have predetermined distances "a" of between 10 to 20 μm, which are sufficient to increase the frequency response of the printhead, but not large enough to cause loss of control of the location of the collapsing bubble. Thus, the width W of the trough 36 is equal to the island width "b" plus both gap distances "a". In the preferred embodiment of FIG. 6, the channel and trough 36 width W is equal to about 65 μm and the gaps 52 have a width "a" equal to about 10 μm.

An alternate embodiment of the invention is shown in FIG. 7, which is a partial plan view similar to that of FIG. 6. The only difference is that the upstream wall 56 of the island of thick film layer 54 is tapered to prevent ink flow stagnation that may occur in the embodiment of FIG. 6. The tapered wall 56 is shown having a triangular shape with the apex pointing upstream of the heating elements towards the reservoir; however, other flow streamlining shapes could be used, such as, for example, a gradual taper that becomes larger as the apex is approached (not shown).

Many modifications and variations are apparent from the foregoing description of the invention, and all such modifications and variations are intended to be within the scope of the present invention.

I claim:

1. A thermal ink jet printhead for ejecting and propelling ink droplets to a recording medium on demand during a printing mode in response to electrical signals selectively applied to heating elements contained therein by electrodes connected thereto, the electrical signals energizing the heating elements and causing the formation and collapse of momentary bubbles of vaporized ink on the energized heating elements, each bubble causing the ejection of one droplet, the printhead comprising:

a structure having an ink reservoir in communication with an array of nozzles through a parallel array of elongated channels, one of said heating elements being located in a respective one of the channels a predetermined distance upstream from its associated nozzle: and means for providing substantially equal ink fluid flow impedance between the channel portions upstream and downstream of the heating elements for the ink motion during the printing mode to control the location of the bubble collapse on the heating element, so that said bubble collapse is kept away from the interface connection of the electrodes to the heating elements, thus preventing cavitational damage resulting from the bubble collapse to the vulnerable interface connection.

2. The printhead of claim 1, wherein the means for providing substantially equal ink fluid flow impedances comprises:

an internal channel geometry having walls substantially surrounding each heating element, the walls being substantially vertical and having a predetermined height to promote bubble growth in a direction normal to the heating element while preventing the escape of bubble vapor from the nozzle which causes ingestion of air and printhead failure, the surrounding walls for each heating element including a downstream wall which extends in thickness from the downstream and of the respective heating element to its associated nozzle, opposing parallel side walls on respective heating elements and connected at one end thereof to the downstream wall, the side walls being perpendicular to the downstream wall, and an upstream wall parallel to the downstream wall which extends in thickness in a direction towards the reservoir a distance, so that the upstream wall thickness is strong enough to withstand the forces generated by the growth and collapse of the bubbles and provides the appropriate ink flow impedance as the refill ink flows therepast towards the collapsed bubble on the heating element.

3. The printhead of claim 2, wherein the upstream wall is connected to the side walls to surround the outer periphery of each of the heating elements completely with said walls.

4. The printhead of claim 2, wherein the upstream wall is spaced from each side wall to produce a gap between each end of the upstream wall and the side walls through which the ink may flow, as well as over the upstream wall, to further reduce the ink flow impedance.

5. The printhead of claim 4 wherein the upstream wall is tapered toward the reservoir to prevent flow stagnation of the ink and further reduce flow impedance in the upstream channel portion.

6. The printhead of claim 2, wherein said structure comprises:

a mated upper substrate, a lower substrate, and a patterned thick film polymer layer sandwiched therebetween, the upper substrate being silicon and having etched recesses in one surface thereof, the recesses being a plurality of parallel elongated grooves and a through recess with an open bottom, one end of the grooves being in communication with the through recess and the other ends of the grooves being open, the lower substrate having the array of heating elements formed on one surface thereof with addressing electrodes connected to the upstream end of the heating elements and common return electrode connected to the downstream end of the heating elements and common return electrode connected to the downstream end of the heating elements, so that, when the upper and lower substrates are mated, the elongated grooves serve as the channels the through recess serves as the ink reservior, and the channel open ends serve as the nozzles; and wherein the walls surrounding the heating elements are provided by the patterned thick film layer, the thick film layer being etch-patterned to produce at least two sets of recesses therethrough, the recesses in one set each exposing the heating elements on the lower substrate, thus placing them individually in a pit having substantially vertical walls, and the recesses in a second set being elongated and aligned with the ink channels, one end of the elongated recesses extending from within the reservoir to an opposite end which terminates at a wall adjacent and spaced from the pit wall on the upstream end of the heating element, so that a solid portion of thick film layer extends across said upstream end of the heating element, thereby causing all of the ink to flow thereover, the distance between the walls of the adjacent elongated recess and pit being sufficient to withstand the forces generated by the growth and collapse of the bubbles and of appropriate length to balance substantially the ink flow impedance therepast with that of the channel portions downstream of the heating elements.

7. The printhead of claim 6, wherein the pit walls at the upstream end of heating elements and the adjacent elongated recess walls do not extend completely across the upstream ends of the heating elements, so that an island of thick film layer is formed that permits the passage of ink therearound as well as thereover to reduce any impact on the frequency response of the printhead.

8. A method of controlling the location of bubble collapse on each of a plurality of heating elements, the heating elements each being located in a capillary filled channel which provides communication between an ink reservoir and an array of nozzles in a thermal ink jet printhead, the heating elements being located a predetermined distance upstream of the nozzles and, when energized by an electrical pulse applied to the heating elements through electrodes connected at the upstream and downstream ends of the heating elements, the heating elements eject ink droplets; from the nozzles by the formation and collapse of ink vapor bubbles thereon, the method comprising the steps of:

(a) forming a first wall of predetermined height within each of the channels at the downstream end of each of the heating elements and for the full width of the channel, and extending the thickness of the first walls from the heating elements to the nozzles; and (b) forming a second wall of predetermined height within each of the channels at the upstream end of each of the heating elements and extending the thickness of the second walls in a direction toward the reservoir for a predetermined thickness to balance the ink flow impedances between the channel portions which are upstream and downstream of the heating elements, so that the bubble collapse on the heating elements are substantially centered thereon and kept away from the electrode connections.

* * * * *